US008353238B1

(12) United States Patent
Montgomery et al.

(10) Patent No.: US 8,353,238 B1
(45) Date of Patent: Jan. 15, 2013

(54) BLIND-MATING ROCKET LAUNCHER CONNECTOR AND PROTECTION SYSTEM

(75) Inventors: Matthew R. Montgomery, Clearwater, FL (US); M. Keith Stephens, Clearwater, FL (US); W. Noel McCormick, Dunedin, FL (US); Paul D. Stevenson, Seminole, FL (US)

(73) Assignee: Arnold Defense and Electronics, LLC, Arnold, MO (US)

( * ) Notice: Subject to any disclaimer, the term of this patent is extended or adjusted under 35 U.S.C. 154(b) by 139 days.

(21) Appl. No.: 13/096,665

(22) Filed: Apr. 28, 2011

Related U.S. Application Data

(60) Provisional application No. 61/394,653, filed on Oct. 19, 2010.

(51) Int. Cl.
*F41F 3/04* (2006.01)

(52) U.S. Cl. ..... 89/1.811

(58) Field of Classification Search ..... 89/1.8, 89/1.806, 1.809, 1.81, 1.811, 1.819
See application file for complete search history.

(56) References Cited

U.S. PATENT DOCUMENTS

| | | | | |
|---|---|---|---|---|
| 3,468,213 | A * | 9/1969 | Hersh et al. | 89/1.8 |
| 3,958,490 | A * | 5/1976 | Zellmer et al. | 89/1.807 |
| 4,358,983 | A * | 11/1982 | Fallon et al. | 89/1.806 |
| 4,444,087 | A * | 4/1984 | Hunter et al. | 89/1.802 |
| 4,750,404 | A * | 6/1988 | Dale | 89/1.819 |
| 4,802,400 | A * | 2/1989 | Griffin et al. | 89/1.57 |
| 5,533,433 | A * | 7/1996 | Giesenberg et al. | 89/1.806 |
| 5,889,226 | A * | 3/1999 | Giesenberg et al. | 89/1.812 |
| 7,340,986 | B1 * | 3/2008 | Gaigler | 89/1.806 |
| 7,647,856 | B2 * | 1/2010 | Park et al. | 89/1.806 |
| 2007/0175323 | A1 * | 8/2007 | Kim et al. | 89/1.819 |
| 2011/0265637 | A1 * | 11/2011 | Hainze et al. | 89/1.806 |
| 2012/0055322 | A1 * | 3/2012 | Angeloff et al. | 89/1.811 |

* cited by examiner

*Primary Examiner* — Bret Hayes
(74) *Attorney, Agent, or Firm* — Kevin L. Klug

(57) ABSTRACT

A blind-mating rocket launcher connector and protection system having a connector, a floating connector member, a cam, a connector cover, and a linkage between the cam and connector cover whereby the connector may mate with a second connector when the cam is displaced despite misalignments between the first and second connector. For the preferred embodiment, the floating connector member has multiple degrees of freedom with a reduced diameter portion and a lengthwise key whereby the connector is capable of mating with an aerodynamic hood of a rocket. The preferred embodiment biases and closes the connector cover upon the connector prior to a plume of the rocket passes the connector whereby exposure of the connector to the deleterious effects of the plume are minimized.

20 Claims, 19 Drawing Sheets

BLIND-MATING ROCKET LAUNCHER CONNECTOR AND PROTECTION SYSTEM

This application claims priority of U.S. Provisional Patent Application No. 61/394,653, filed Oct. 19, 2010, entitled Blind-Mating Rocket Launcher Connector and Protection System.

BACKGROUND OF THE INVENTION

The art of the present invention relates to rocket launchers utilized in military applications in general and more particularly to a protected and reusable connector apparatus and method of use which allows electronic transfer of guidance information to guided rockets and further allows the guided rockets to launch without damage to the connector apparatus. That is, the temperatures, pressures, and soot particles of a rocket plume are so severe that conventional connection mechanisms would fail.

Unguided rockets have been utilized by militaries since prior to World War II and are in use to this day. An example of such an unguided rocket is the unguided Hydra 70. It is a 2.75 inch (70 mm) folding fin aerial rocket developed by the United States and is utilized throughout the world. The rocket is a point and shoot weapon without laser, radar, fly-by-wire, or any other type of guidance system. The rocket is further utilized with many types of fixed and rotary wing aircraft and is especially adept at providing close air support to ground forces. Examples of said aircraft include, but are not limited to, the OH-58D(R) Kiowa Warrior, the AH-64D Apache Longbow, and the AH-1 Cobra.

The aforesaid and other types of unguided rockets are typically held, transported, and launched or fired from a rocket launcher attached on or to an aircraft. The aforesaid launchers most often utilized with said unguided 2.75 inch rockets are the M260 pod which holds seven rockets (i.e. a tubular canister having six circumferential tubes with one tube in the center) and the M261 pod which holds 19 rockets (i.e. a tubular canister having five tube rows of three, four, five, four, and three from the front face top to bottom). Said pods have interfaces which fit with and are held by the bomb racks on the aircraft or other vehicle and are often referred to as a rail or drum launcher. The aforesaid launchers have ignition contacts near the rear of each tube and detention mechanisms within each tube which hold the rocket in place during transport and prior to launch. As conventional 2.75 inch rockets such as the Hydra 70 are unguided, there has been little need for any further connection or interface mechanisms.

Presently, there is a desire to incorporate precision guidance mechanisms or capabilities into the 2.75 inch rockets (or other rocket types) and provide a launcher pod that is able to interface with said guided rockets yet mate with or mount to an aircraft (or other vehicle) as the M260 or M261 with a minimum of aircraft modifications. An example of such a rocket is the laser-guided 2.75 inch (70 mm) Hydra rocket called the Guided Advanced Tactical Rocket-Laser (GATR-L, a.k.a. Gator). The present art applies not only to the aforesaid but also to any precision guided rockets having or containing a lock-on-before-launch capability. This requires that guidance information be supplied from the aircraft (or other transport vehicle) to the rocket in real time prior to launch. It also requires that upon launch of said rocket, the interfacing connectors be protected from the extremely high temperatures, soot, and pressures of the rocket exhaust or plumes.

The present art utilizes a conventional M260 pod and adds an extender module (for the preferred embodiment approximately 10 to 11 inches in length) having the present art blind-mating rocket launcher connector and protection system near or at the front portion of said M260 pod or extender module without any modification to the aforesaid M260 pod or the extender module attached to the M260 pod. The present art utilizes the six circumferential tubes of the M260 pod for holding, transporting, and launching the guided rockets with the center tube utilized for placement of interface and control electronics. A platform or firing management system on board the vehicle interfaces with the interface and/or control electronics. The present art blind-mating rocket launcher connector and protection system allows for passage of electronic data to the guided rocket to lock on to a pulse coded laser illumination of the target prior to and after launch. Alternative embodiments of the extender module which incorporate the present art may be of any length, width, or diameter.

The laser-guided 2.75 inch (70 mm) rocket has a protruding aerodynamic hood (i.e. rail or extension) with a female electrical connector which mates with the present art having a male electrical connector. (As understood by those skilled in the arts, electrical connectors typically have one or more pins or sockets within, often collectively referred to as pins.) As seen in FIGS. 8-13 & 30-31, the laser-guided rocket female connector has male pins and the present art male connector has female sockets or pins. That is, the present art has a launch tube keyway within which said aerodynamic hood slides and blindly mates with the male (with female pins or sockets) electrical connector therein. For enablement purposes only and by no means a limitation to the present art, additionally, the aforesaid guided rocket typically has six unfolding fins near the rear and four guidance canards near the front with the aforesaid female electrical connector in front of said canards. An electrical guidance (i.e. data) interface is provided through the present art apparatus and into said female electrical connector on the guided rocket. The preferred embodiment electrical connector has 10 pins with alternative embodiments capable of incorporating varied pin quantities and arrangements.

Unique to the present art is the ability of the male (i.e. with female pins or sockets) electrical connector to provide a self centering connection with said guided rocket with sufficient alignment tolerances or float to ensure a positive blind mating. Additionally, upon launch of said guided rocket, the male (i.e. having female pins or sockets) connector re-centers within a housing of the present art and a cover immediately overlays the connector in order to protect the connector sockets or contacts from the temperatures, pressures, and soots of the rocket plume. This action occurs prior to the rocket plume reaching the connector. As understood by those skilled in the art, the male-female connector and pin relationship of the guided rocket and the present art blind-mating rocket launcher connector and protection system may be reversed without departing from the scope and spirit of the present art.

Accordingly, it is an object of the present invention to provide a blind-mating rocket launcher connector and protection system and method of use which is capable of quickly and easily mating with a guided rocket, providing connector self centering or alignment capability, and also protecting the connector from the harsh environment of rocket launch.

Another object of the present invention is to provide a blind-mating rocket launcher connector and protection system and method of use which is highly tolerant of rocket and component mismatch do to misalignments or tolerance limits.

Another object of the present invention is to provide a blind-mating rocket launcher connector and protection system and method of use which provides a unique cam, linkage, and connector cover structure that covers the sensitive electronic data connector prior to rocket exit and connector exposure to the deleterious effects of rocket exhaust plume.

SUMMARY OF THE INVENTION

To accomplish the foregoing and other objects of this invention there is provided blind-mating rocket launcher connector and protection system and method of use. The apparatus and method of use provides guided rocket capabilities to existing unguided rocket pods or canisters with a minimum of alteration to the existing pods or canisters or the fire control electronics associated therewith. The apparatus and method of use is especially useful to militaries which desire guided rocket capabilities with a minimum of upgrade cost yet require an easily loaded, dependable, and robust guided rocket connection and interface system.

The preferred embodiment of the present art blind-mating rocket launcher connector and protection system first comprises an extender assembly having one or more extender tubes which attaches with a conventional M260 pod or launcher and within which the apparatus of the present art is contained or housed. The extender assembly and an M260 pod are used in combination as a launcher system for a guided rocket.

Each of said extender tubes comprises a tubular member having a slot from a front portion extending toward a rear portion and into which a keyway assembly is fitted and attached. The keyway assembly provides a "U" shaped channel or launch tube keyway into which an aerodynamic hood of the guided rocket slides and the connector of the guided rocket interfaces and connects or blind mates with the blind-mating rocket launcher connector and protection system.

The blind-mating rocket launcher connector and protection system is designed to facilitate communication between a guided rocket and the launcher through a connector interface. It allows the rocket and the launcher connectors to be blind-mated during rocket loading, and ensures the launcher connector is protected from the rocket exhaust plume during launch. The blind-mating rocket launcher connector and protection system is especially functional with a tube launched rocket where the exhaust plume of the rocket passes through the launch tube and past the launcher connector, but could be used in any application where the connector requires protection from external elements.

The blind-mating rocket launcher connector and protection system comprises two mechanisms, the launcher connector mechanism and the protective cover mechanism. These mechanisms are housed inside of a launch tube keyway assembly near or at the front of the launch tube or extender tube. The launch tube keyway aligns with the aerodynamic hood at the front of the rocket that contains the rocket connector. The two mechanisms work in harmony to ensure proper operation of the launcher connector. The launcher connector is protected prior to installation of the rocket and during the launch of the rocket. The protective cover mechanism automatically retracts out of the way during the rocket loading process. Once the launcher connector is exposed, the blind mating features and the ability of the launcher connector mechanism to float with multiple degrees of freedom ensures that the connectors properly mate regardless of the rocket position in the launch or extender tube or the connector to connector misalignment. As the rocket exits the tube, the launcher connector mechanism and protective cover mechanism quickly return to a home or default position. This ensures protection and proper positioning of the launcher connector whereby said connector is properly positioned for the next rocket insertion.

The launcher connector mechanism or assembly is captive inside the launch tube keyway assembly. Said keyway assembly has a connector mechanism slot within which a floating connector member fits and is retained. The floating connector member also acts as a protector or protective device for the launcher connector wires. The wires are thus protected inside the floating connector member from the rocket exhaust plume as it passes through the launch tube and launch tube keyway. A protective cover mechanism protects said launcher connector and also retracts out of the way during installation of the rocket via the action of a cam. The connector cover pivots rearward and contacts the launcher connector forming a protective seal.

In operation, as a rocket is loaded, the aerodynamic hood presses against the cam and the insertion force of the rocket rotates the cam in the aft direction and simultaneously rotates the connector cover forward and exposes the launcher connector for mating with the rocket connector. Upon rocket ignition and during the nascent stages of rocket forward movement, the aerodynamic hood moves forward past the cam and the connector cover (connected to the cam by one or more linkage bars) simultaneously rotates into place in front of the launcher connector. While the force of the rocket insertion is utilized to retract the connector cover, the mechanism ensures that the force of the rocket exhaust plume cannot do so, even though the force of the supersonic exhaust is many times stronger than the installation force of the rocket.

BRIEF DESCRIPTION OF THE DRAWINGS

Numerous other objects, features and advantages of the invention should now become apparent upon a reading of the detailed description taken in conjunction with the accompanying drawings, in which.

DETAILED DESCRIPTION

Figure 1:
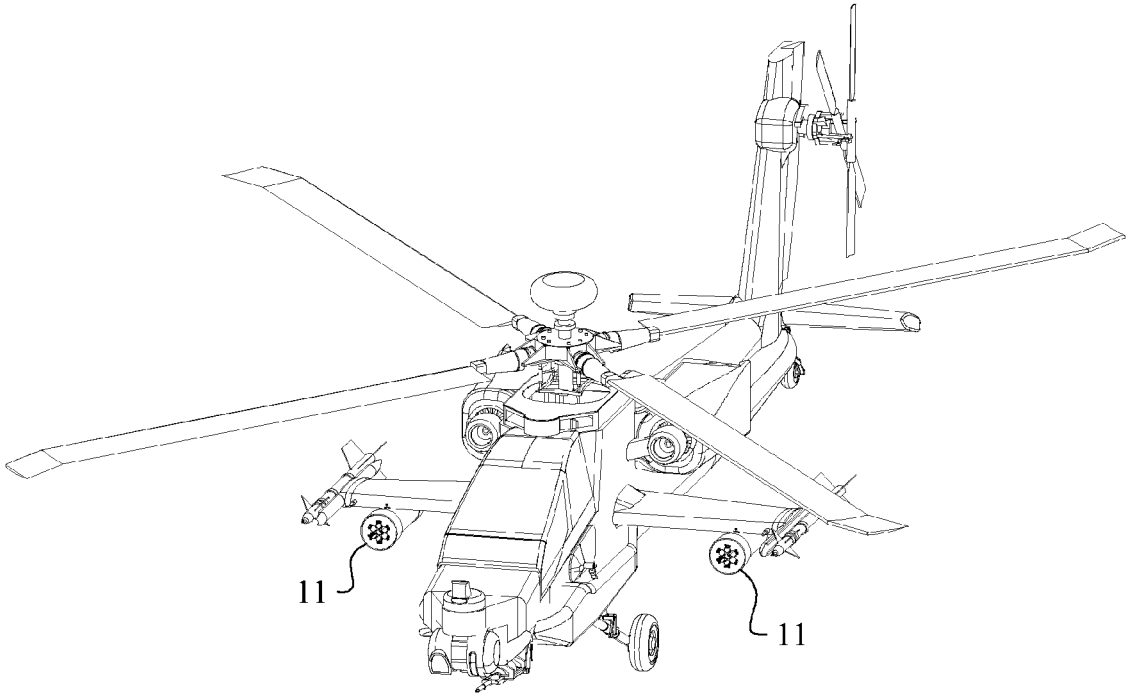
FIG. 1 is a front perspective view of two launchers mounted to an AH-64D Apache Longbow helicopter.
Figure 2:
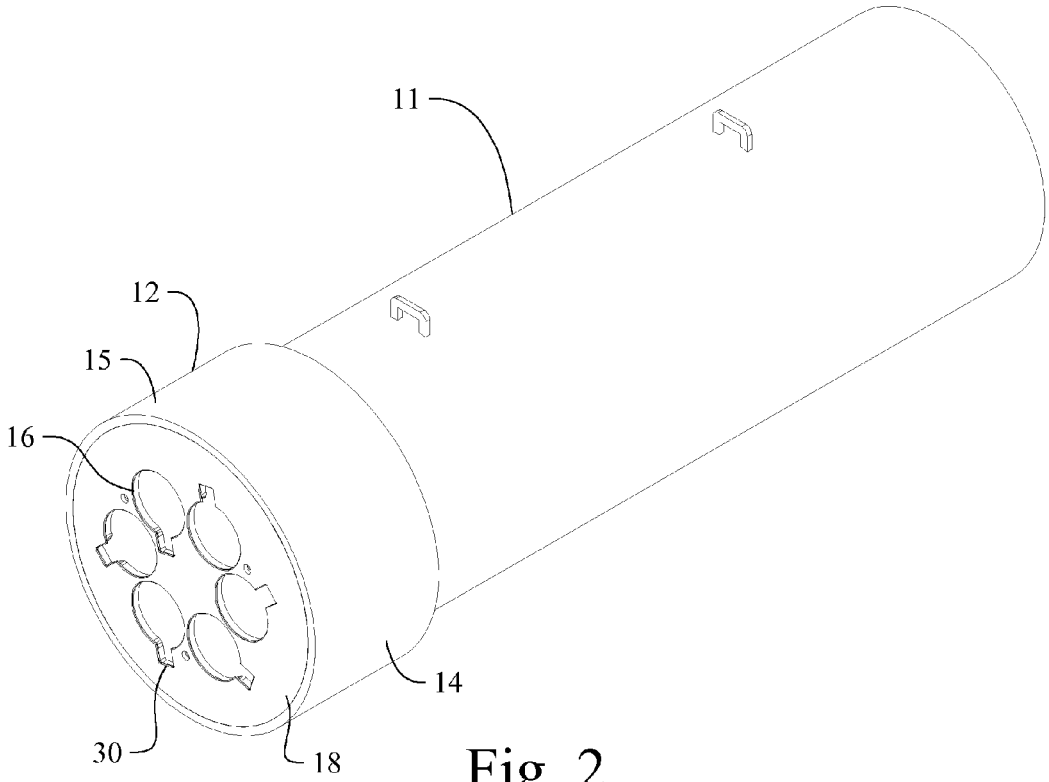
FIG. 2 is a front right perspective view of a launcher with an extender assembly.
Figure 3:
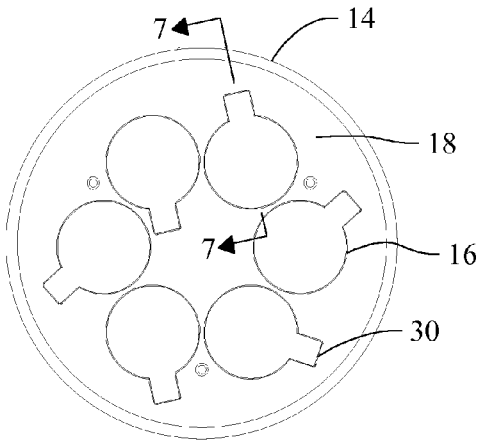
FIG. 3 is a front elevation view of the extender assembly.
Figure 4:
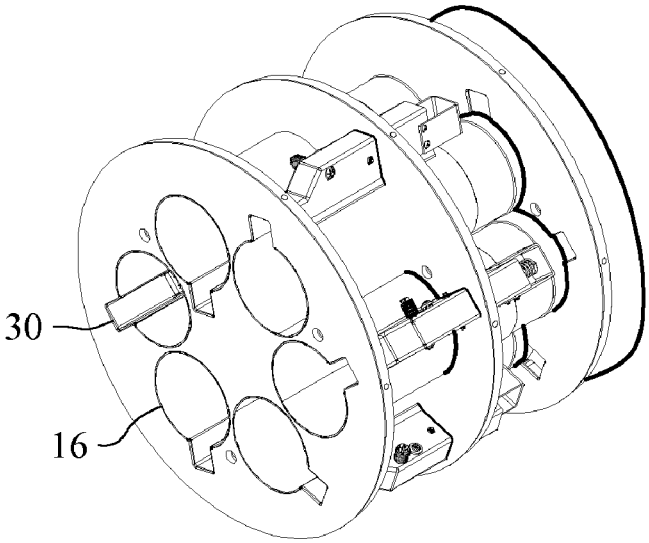
FIG. 4 is a front right perspective view of the extender assembly without an outer skin.
Figure 5:
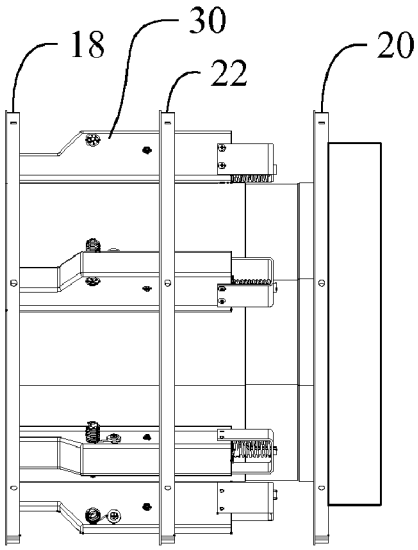
FIG. 5 is a right elevation view of the extender assembly without an outer skin.
Figure 6:
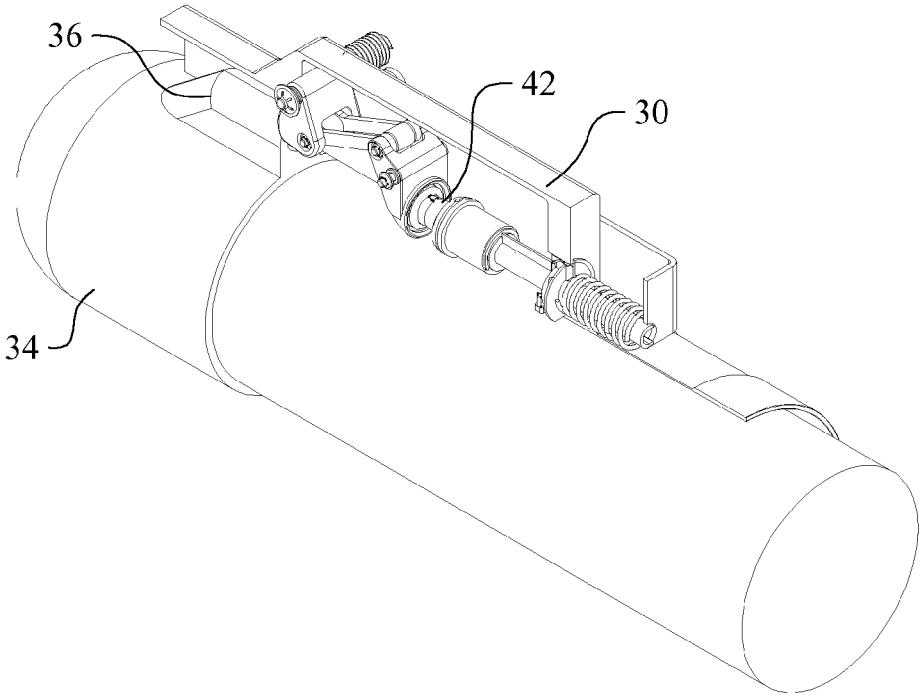
FIG. 6 is a right rear cut-away perspective view of an extender tube and keyway assembly during the initial installation of a guided rocket.
Figure 7:
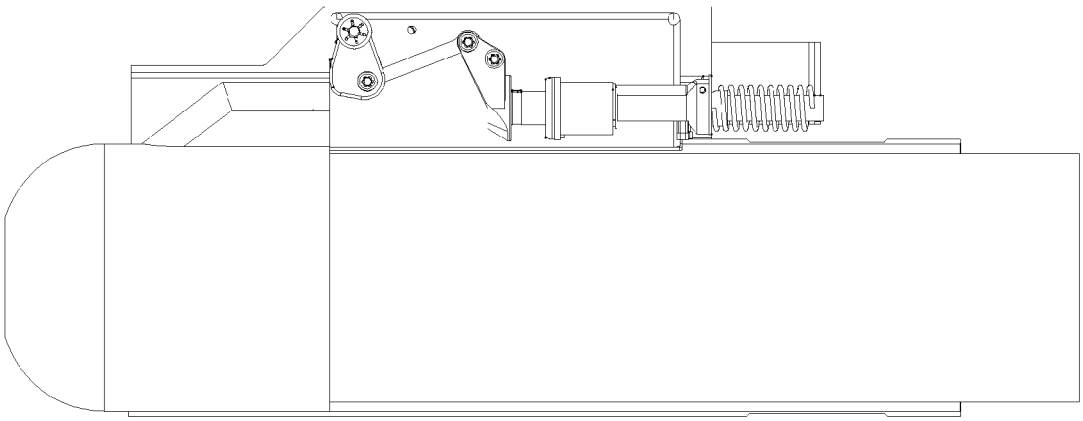
FIG. 7 is a right elevation x-ray view of an extender tube and keyway assembly during the initial installation of a guided rocket taken along lines 7-7 of FIG. 3.
Figure 8:
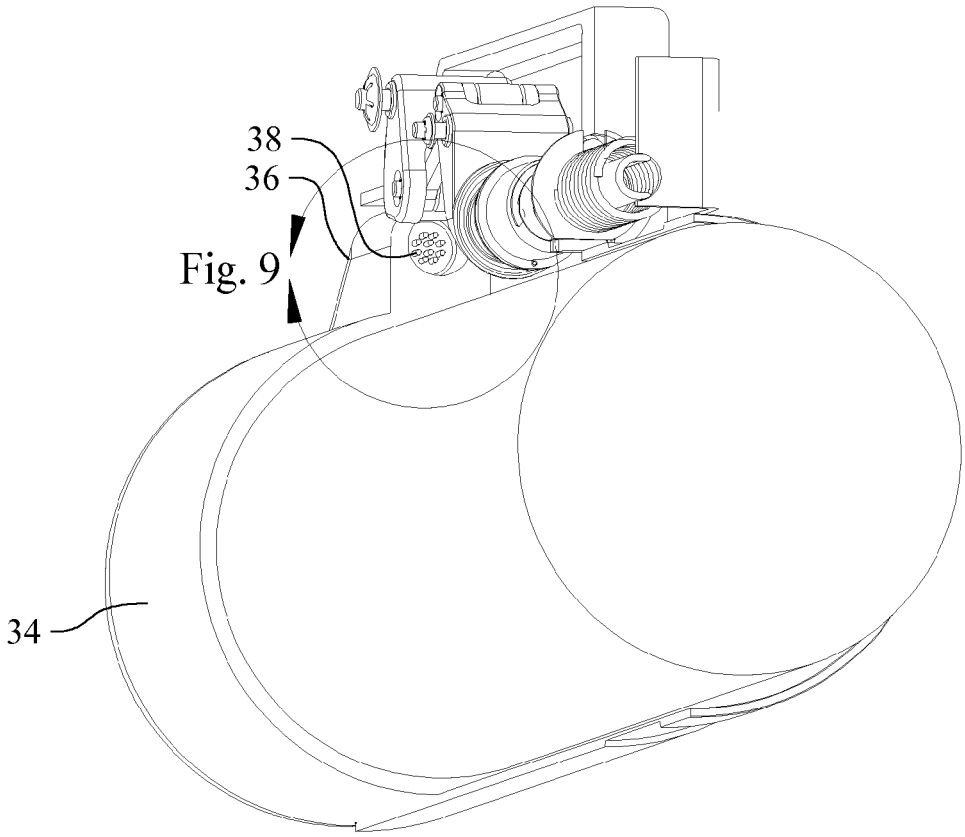
FIG. 8 is a rear cut-away perspective view of an extender tube and keyway assembly during the initial installation of a guided rocket.
Figure 9:
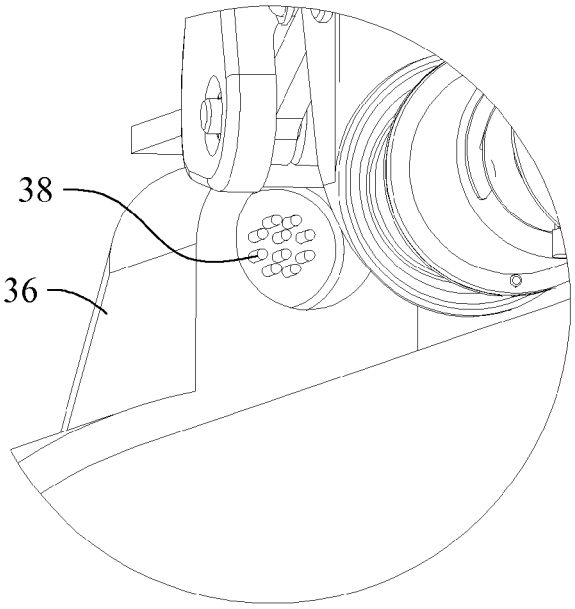
FIG. 9 is an enlarged view of the area FIG. 9 indicated in FIG. 8.
Figure 10:
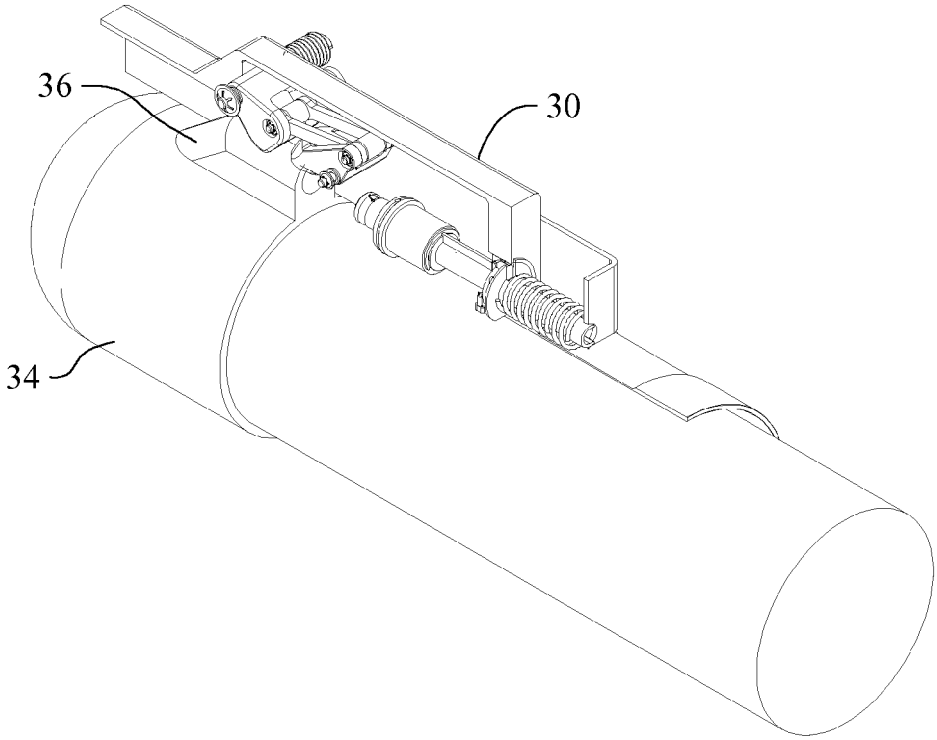
FIG. 10 is a right rear cut-away perspective view of an extender tube and keyway assembly after the aerodynamic hood of a guided rocket impinges upon the cam.
Figure 11:
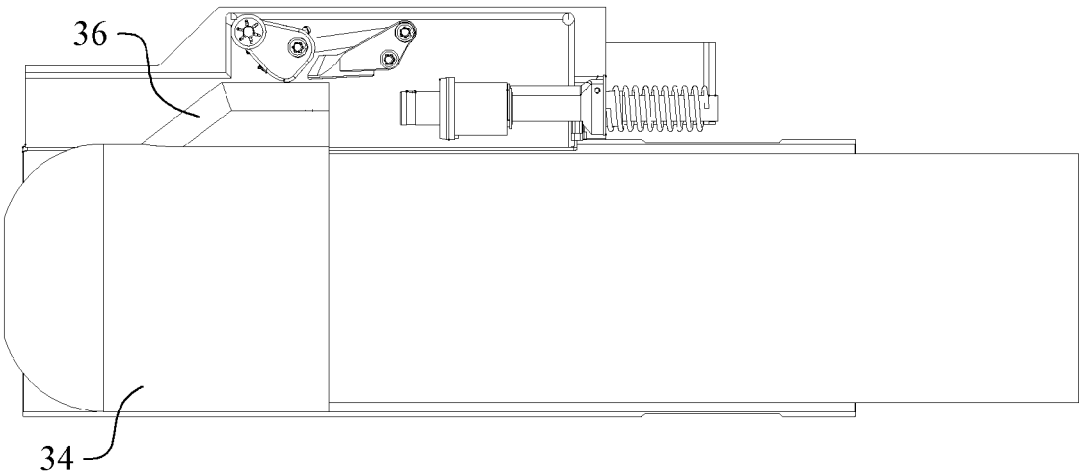
FIG. 11 is a right cut-away elevation view of an extender tube and keyway assembly after the aerodynamic hood of a guided rocket impinges upon the cam.
Figure 12:
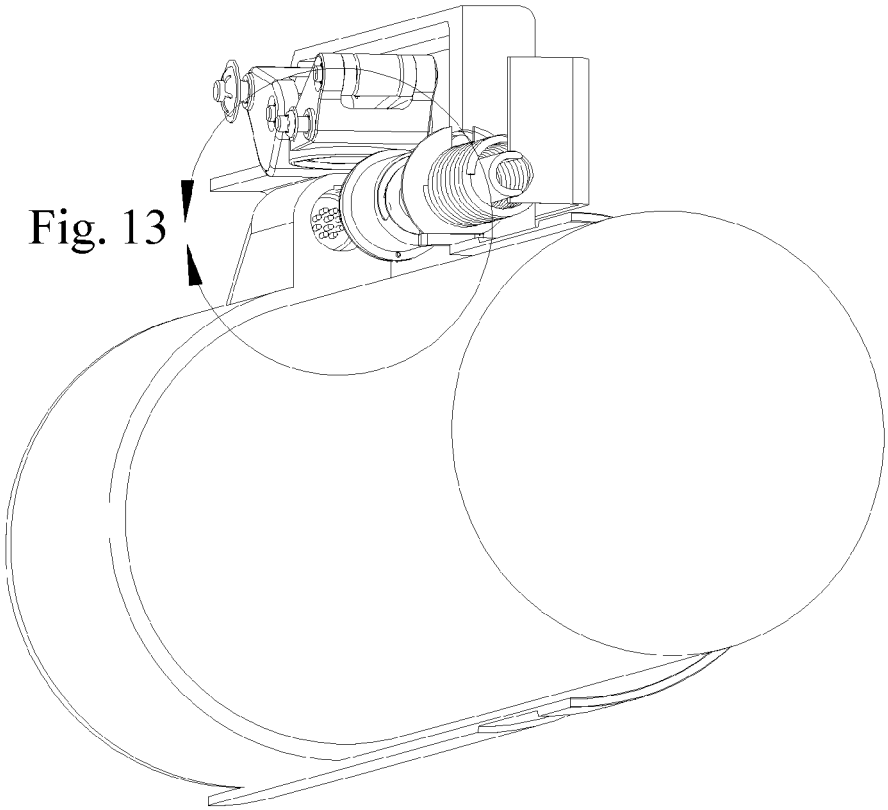
FIG. 12 is a rear cut-away perspective view of an extender tube and keyway assembly after the aerodynamic hood of a guided rocket impinges upon the cam.
Figure 13:
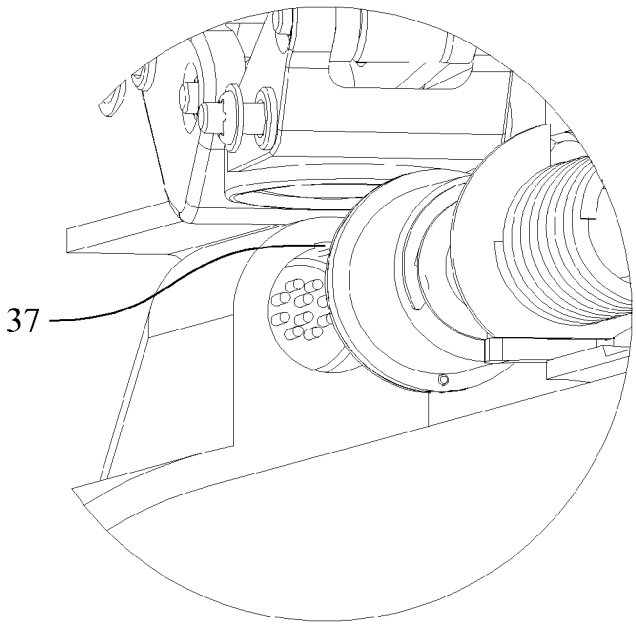
FIG. 13 is an enlarged view of the area 13 indicated in FIG. 12.
Figure 14:
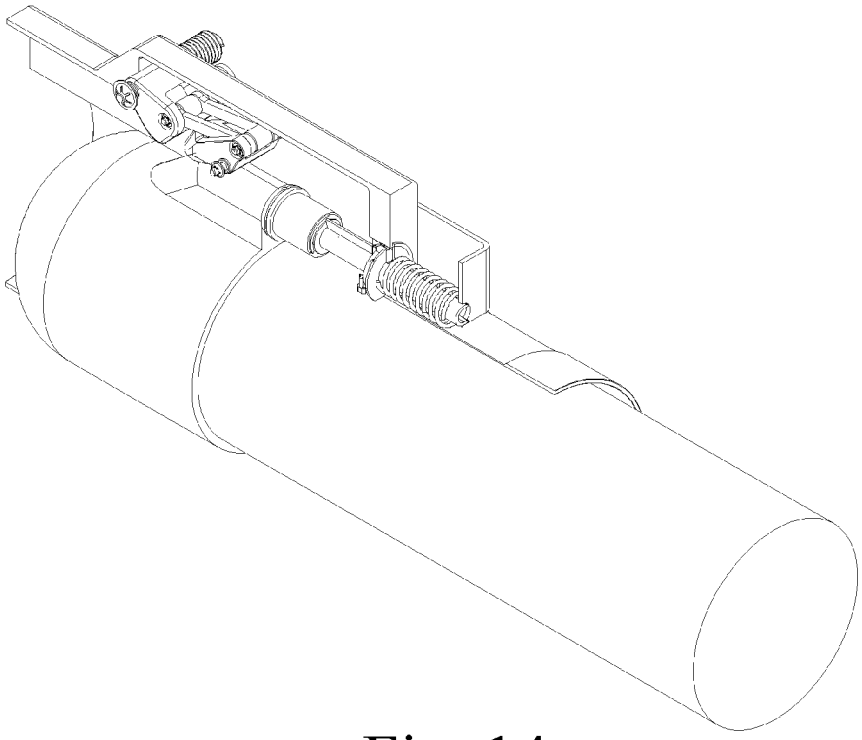
FIG. 14 is a right rear cut-away perspective view of an extender tube and keyway assembly after the rocket connector and launcher connector mate.
Figure 15:
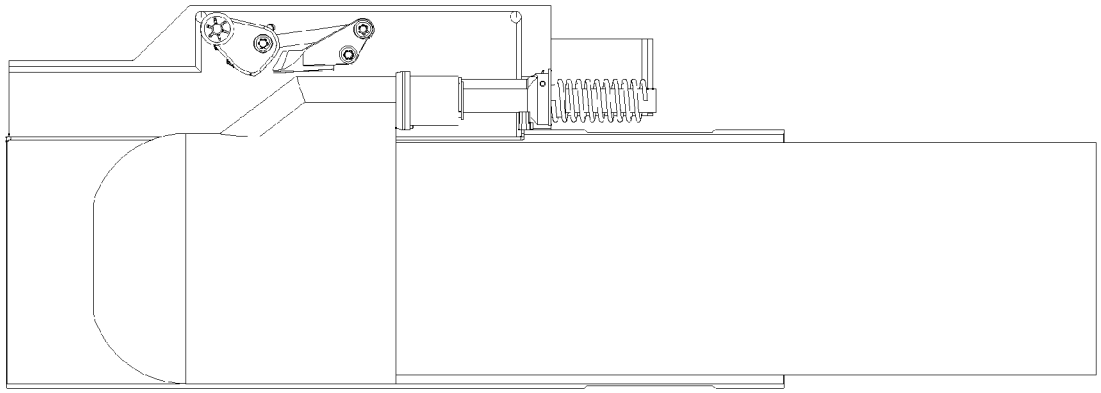
FIG. 15 is a right cut-away elevation view of an extender tube and keyway assembly after the rocket connector and launcher connector mate.
Figure 16:
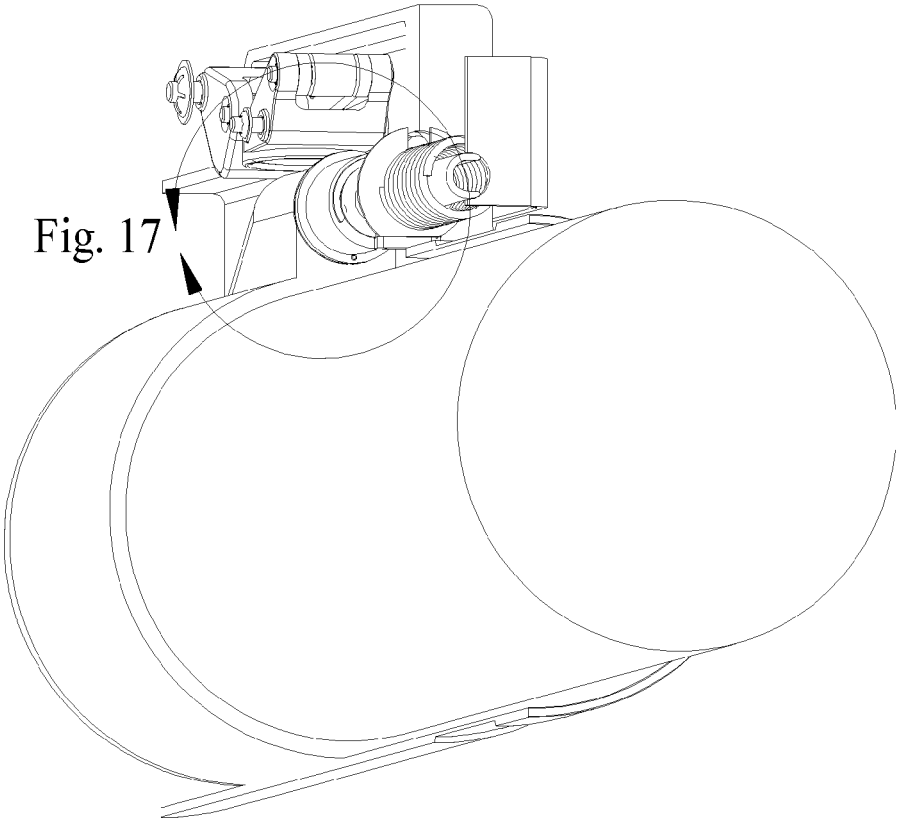
FIG. 16 is a rear cut-away perspective view of an extender tube and keyway assembly after the rocket connector and launcher connector mate.
Figure 17:
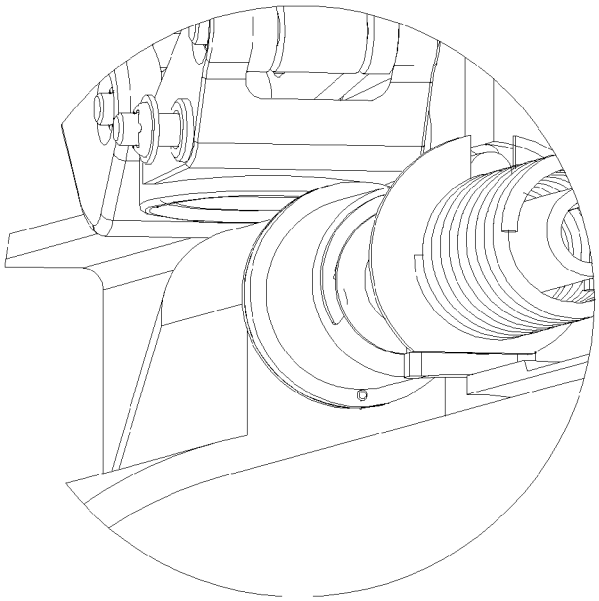
FIG. 17 is an enlarged view of the area 17 indicated in FIG. 16.
Figure 18:
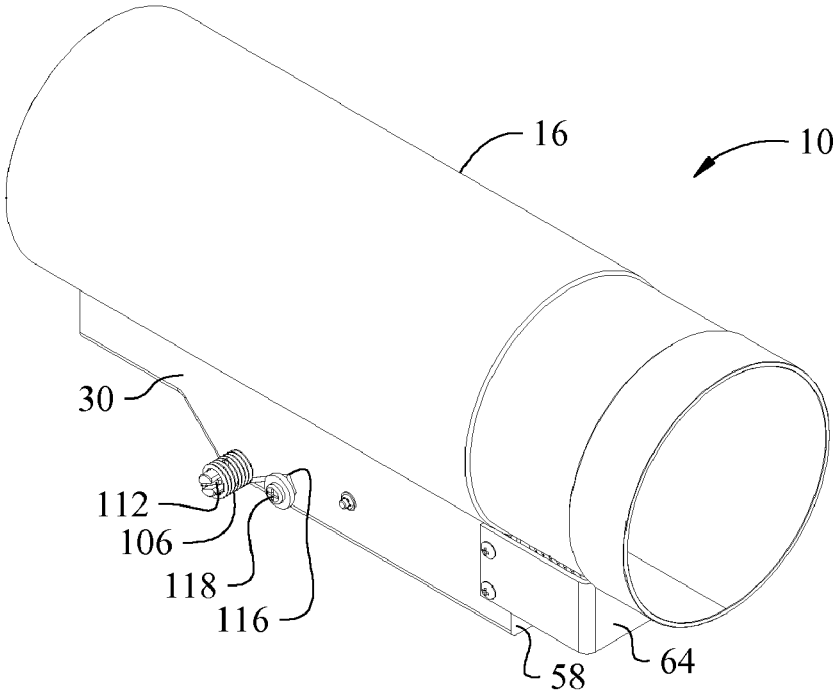
FIG. 18 is a top right rear perspective view of the extender tube with the keyway assembly attached.
Figure 19:
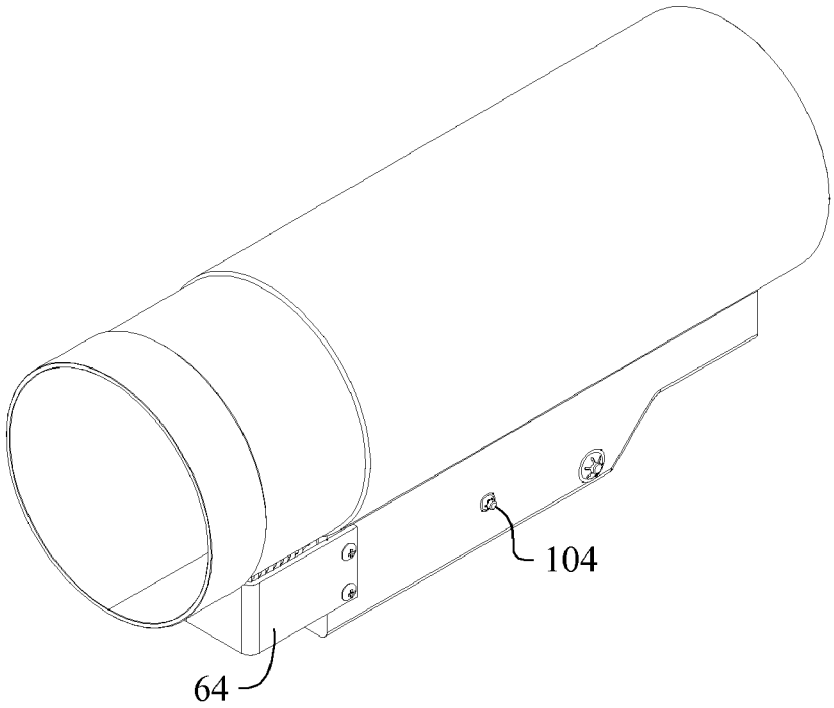
FIG. 19 is a top left rear perspective view of the extender tube with the keyway assembly attached.
Figure 20:
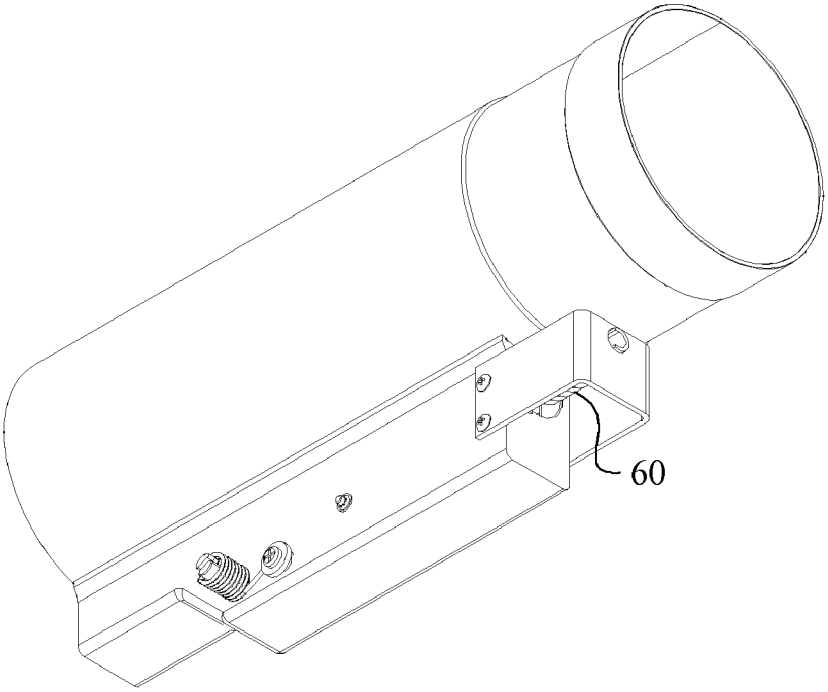
FIG. 20 is a bottom rear perspective view of the extender tube with the keyway assembly attached.
Figure 21:
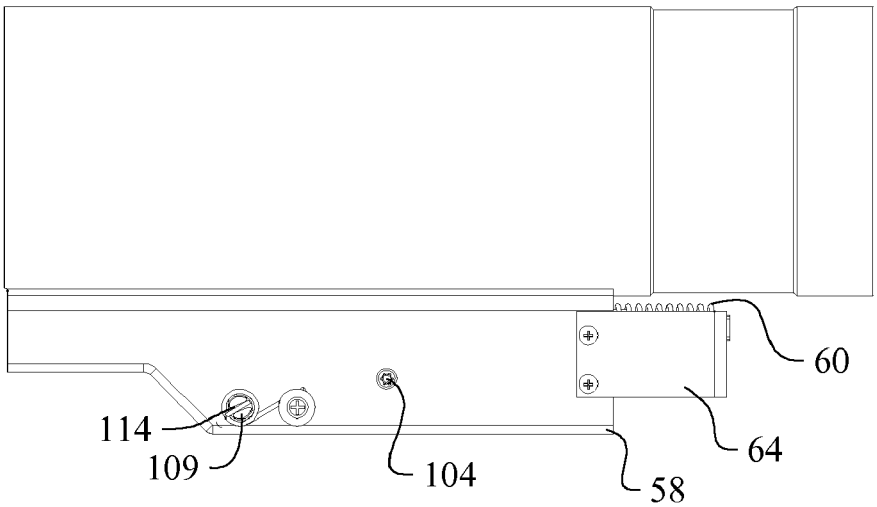
FIG. 21 is a right elevation view of the extender tube with the keyway assembly attached.
Figure 22:
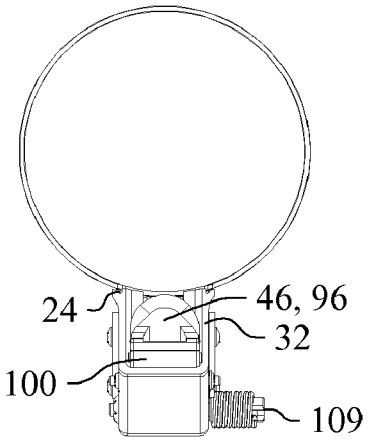
FIG. 22 is a front elevation view of the extender tube with the keyway assembly attached.
Figure 23:
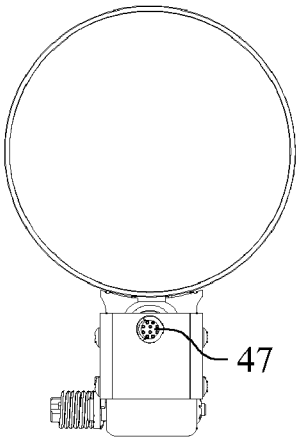
FIG. 23 is a rear elevation view of the extender tube with the keyway assembly attached.
Figure 24:
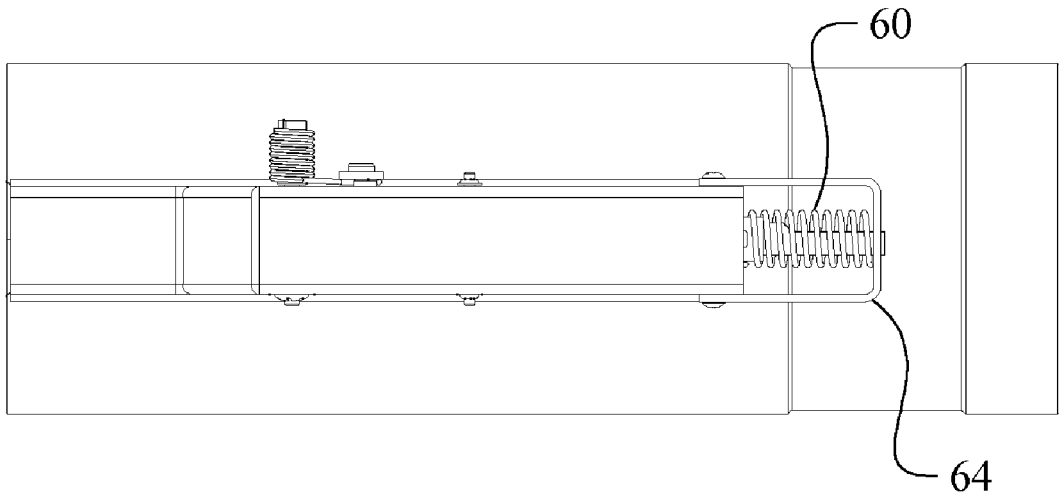
FIG. 24 is a bottom elevation view of the extender tube with the keyway assembly attached.
Figure 25:
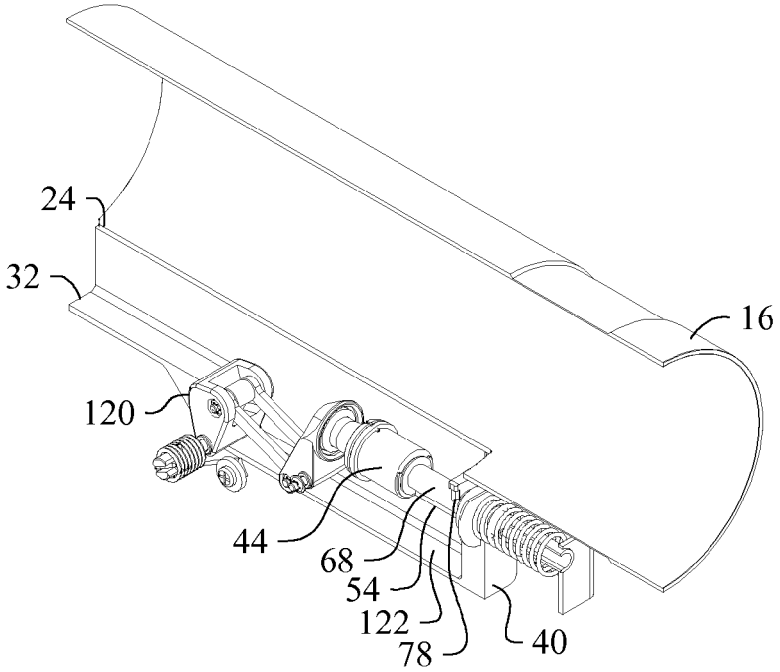
FIG. 25 is a top rear right cut-away perspective view of the extender tube with the keyway assembly attached.
Figure 26:
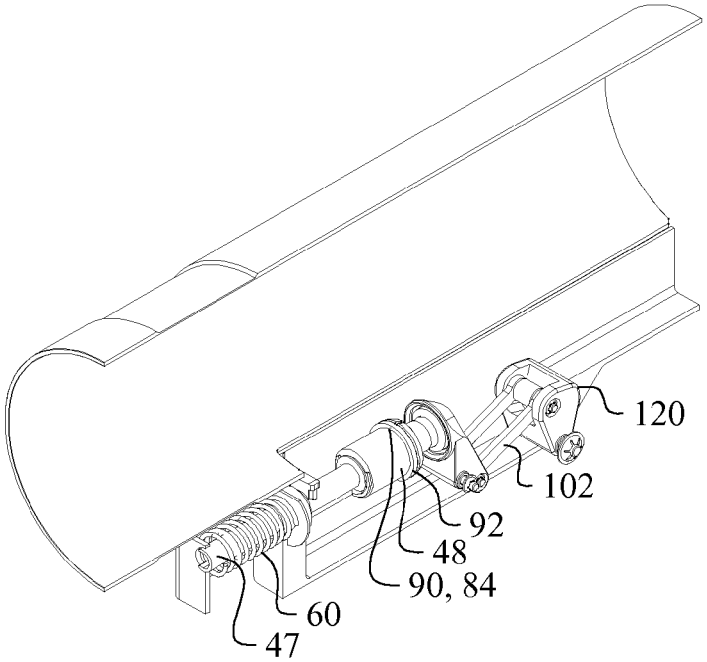
FIG. 26 is a top rear left cut-away perspective view of the extender tube with the keyway assembly attached.
Figure 27:
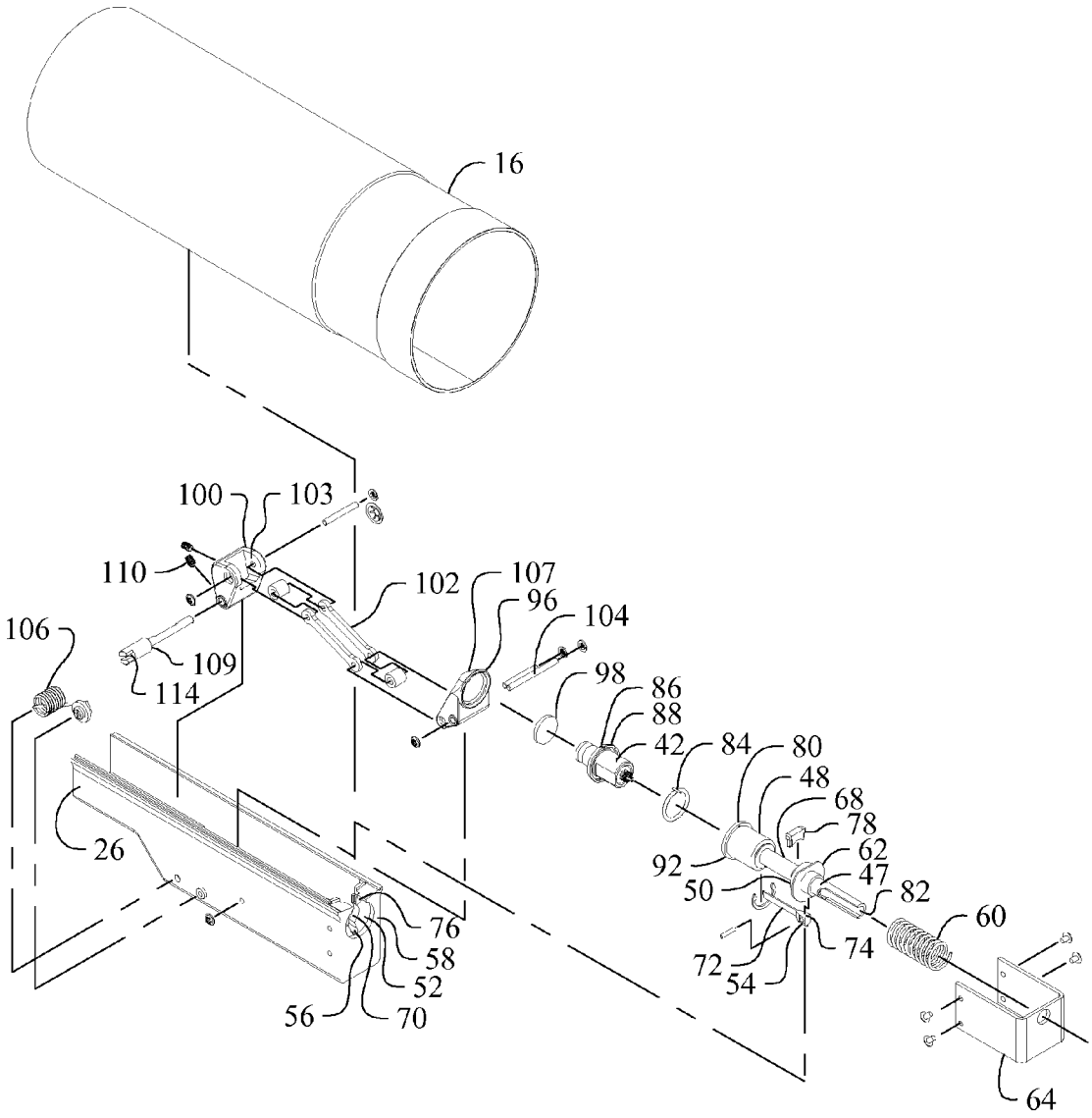
FIG. 27 is an exploded view of the extender tube and the keyway assembly.
Figure 28:
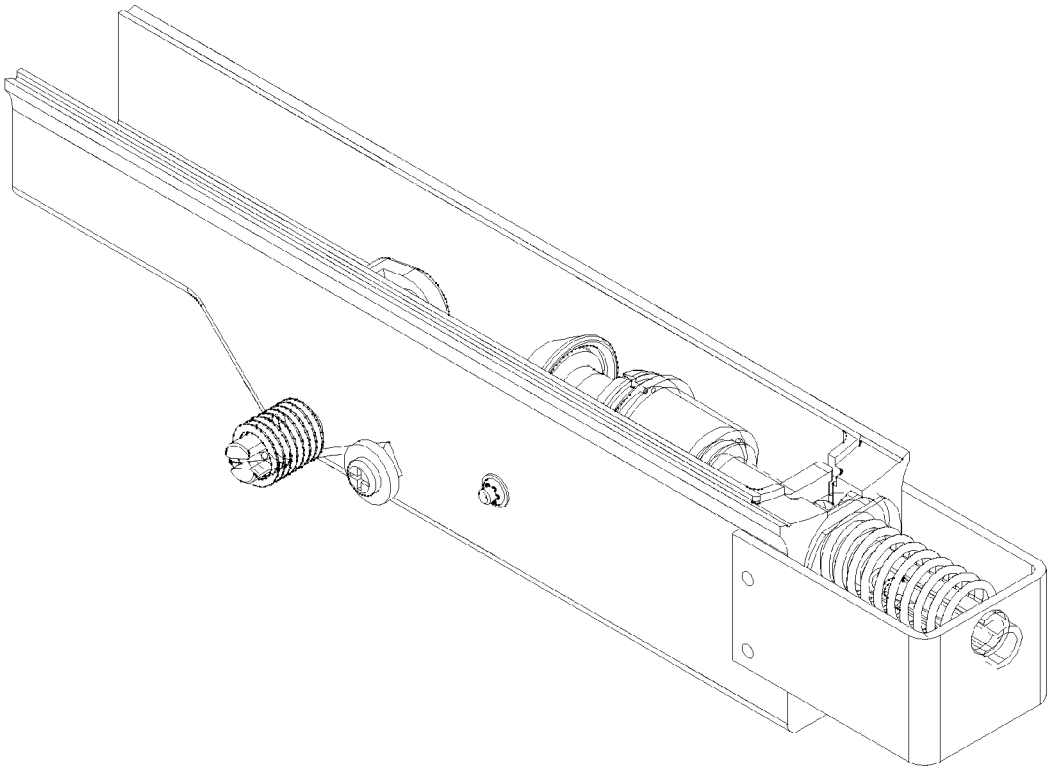
FIG. 28 is a top rear perspective view of the keyway assembly partially showing the range of movement of the floating connector member.
Figure 29:
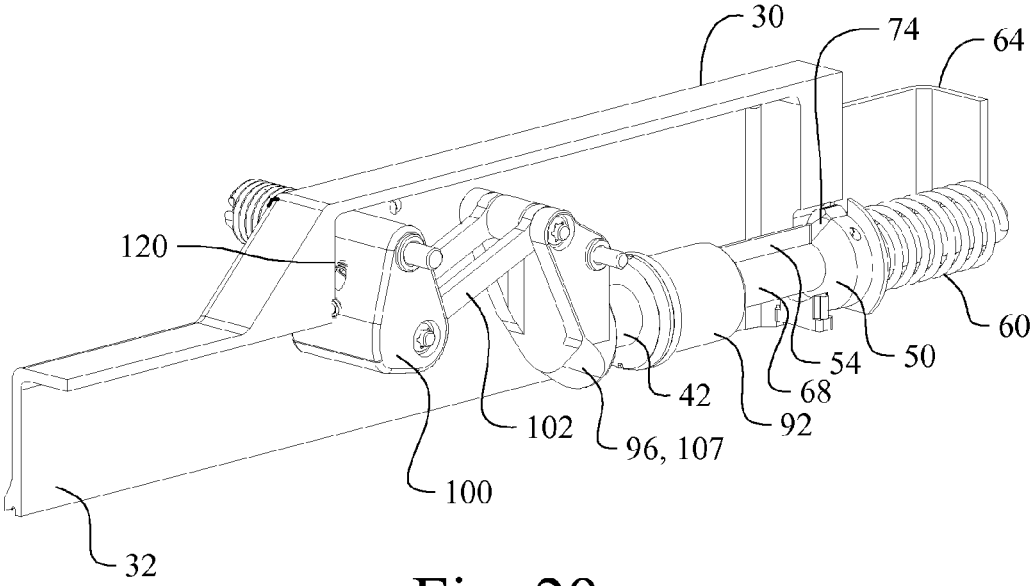
FIG. 29 is a front left cut-away perspective view of the keyway assembly.
Figure 30:
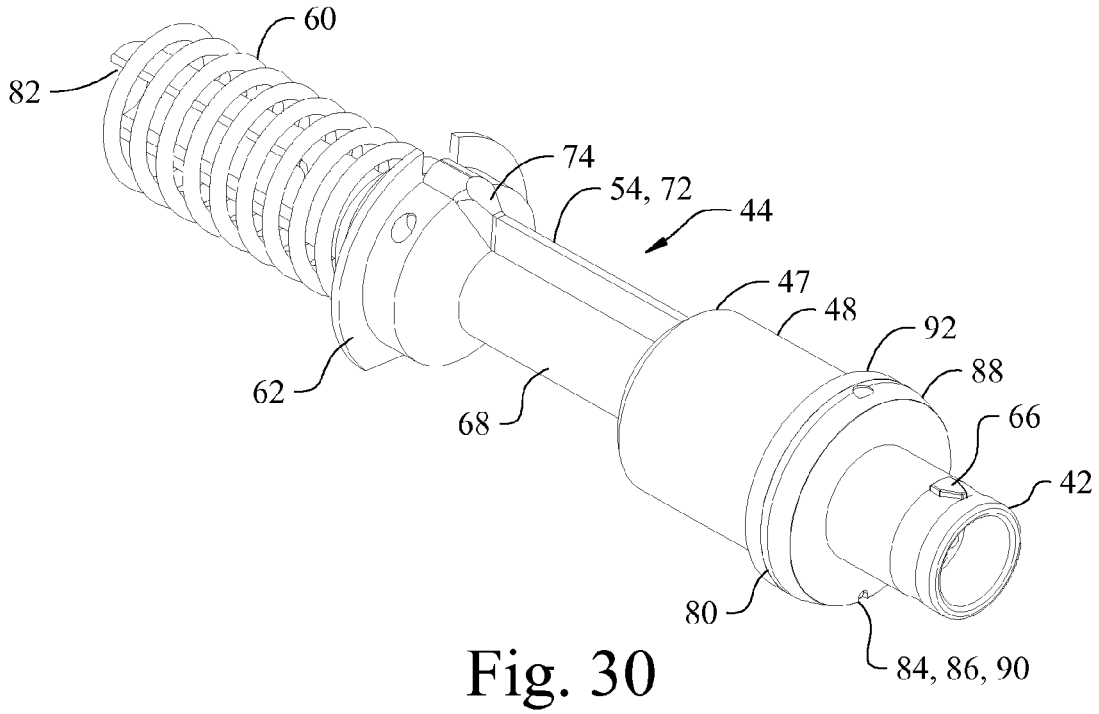
FIG. 30 is a front left perspective view of the launcher connector mechanism.
Figure 31:
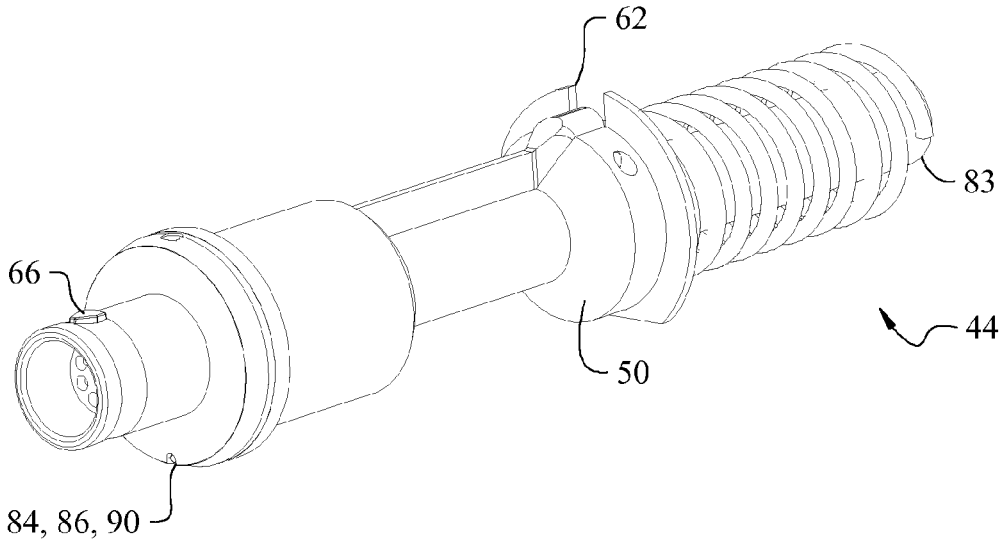
FIG. 31 is a front right perspective view of the launcher connector mechanism.
Figure 32:
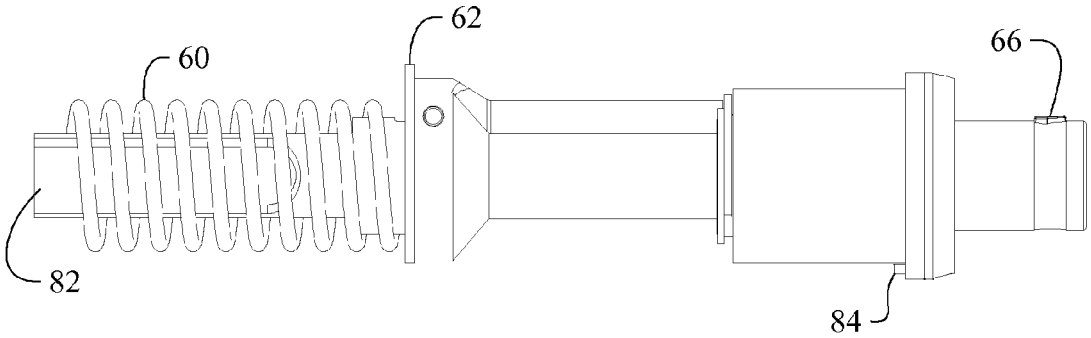
FIG. 32 is a left side elevation view of the launcher connector mechanism.
Figure 33:
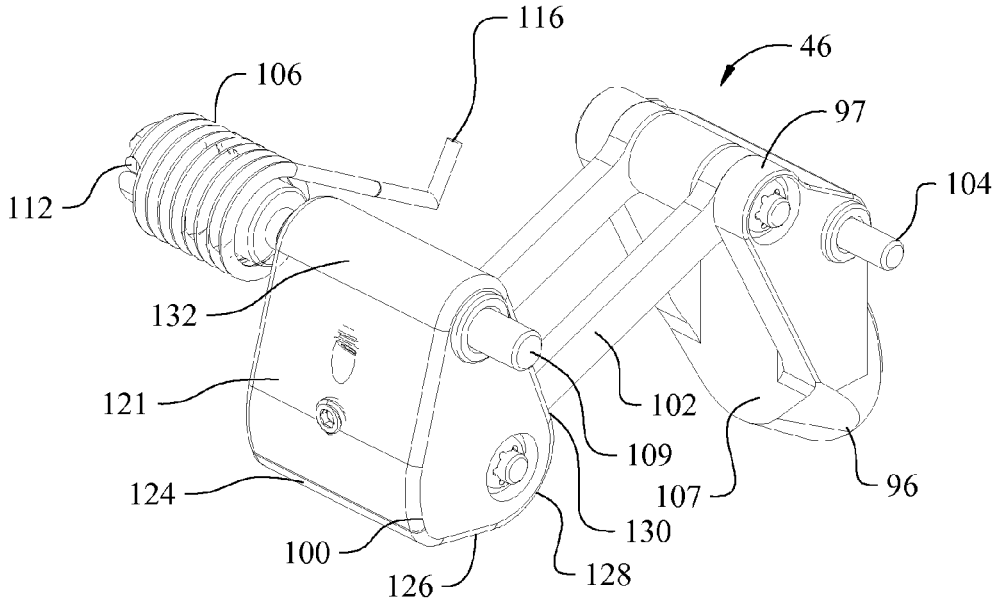
FIG. 33 is a front perspective view of the protective cover mechanism.
Figure 34:
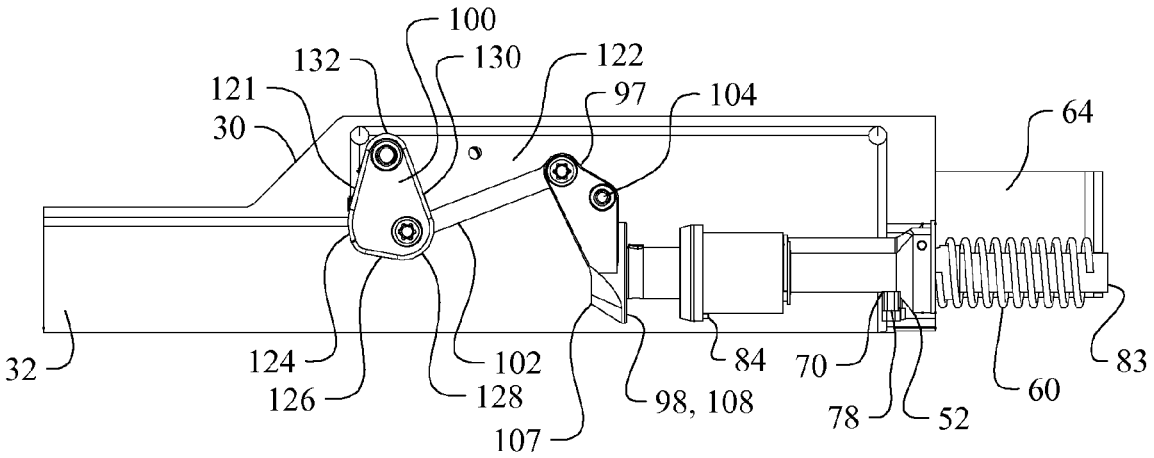
FIG. 34 is a right side cut-away elevation view of the keyway assembly.

Referring now to the drawings, there is shown in FIGS. 6-34 a preferred embodiment of the of the present art blind-mating rocket launcher connector and protection system 10 apparatus, including plan and perspective range of motion views (FIGS. 6-17) between a guided rocket 34 and launcher connector mechanism 44. FIGS. 1-5 further show the environment within which the present art apparatus 10 resides along with the housing 14 and support 18, 20, 22 components.

The preferred embodiment of the present art blind-mating rocket launcher connector and protection system 10 first comprises an extender assembly 12 which attaches with a conventional M260 pod or launcher 11 and within which the apparatus 10 of the present art is contained or housed. The extender assembly 12 comprises a housing 14 having an outer skin 15 and within which is mounted six extender tubes 16. (i.e. an assembly of six extender tubes 16 covered by an outer skin 15) The extender assembly 12 and an M260 pod are used in combination as a launcher 11 system for a guided rocket 34.

In furtherance of environmental placement and support of the present art apparatus 10, each of said extender tubes 16 is mounted between a front support 18 and a rear support 20 with a center support 22 there between with the outer skin 15 surrounding the supports 18, 20, 22. For the preferred embodiment, each of said extender tubes 16 is fit and mounted within openings within said supports 18, 20, 22. The rear support 20 fits over the front of the M260 or launcher 11 and is secured by one or more fasteners to said M260 or launcher 11. Preferably, each extender tube 16 is welded in place with said supports 18, 20, 22 but may be attached via a plurality of methods, including but not limited to fasteners such as screws, frictional fits, adhesives, or electromagnetic forming (i.e. magneforming).

Each of said extender tubes 16 comprises a tubular member having a slot 24 from a front portion 26 extending toward a rear portion 58 and into which a keyway assembly 30 is fitted and attached. Said keyway assembly 30 is preferably attached via welding but may be attached via a plurality of methods, including but not limited to fasteners such as screws, frictional fits, or adhesives. The keyway assembly 30 provides a "U" shaped channel or launch tube keyway 32 into which the aerodynamic hood 36 of the guided rocket 34 slides and the connector 38 of the guided rocket 34 interfaces and connects (i.e. blind mates) with the blind-mating rocket launcher connector and protection system 10. For the preferred embodiment, the keyway assembly 30 has a keyway housing 40 within which all of the components of said assembly 30 are mounted and function. Alternative embodiments of the keyway assembly 30 may not utilize the "U" shaped channel and instead simply function as a housing or mounting platform for the novel elements of the present invention.

The blind-mating rocket launcher connector and protection system 10 is designed to facilitate communication between a guided rocket 34 and the launcher 11 through a connector 42 interface. It allows the rocket 34 (i.e. connector 38 thereon) and the launcher connector 42 to be blind-mated during rocket 34 loading, and ensures the launcher connector 42 is protected from the rocket 34 exhaust plume during launch. The blind-mating rocket launcher connector and protection system 10 is especially functional with a tube launched rocket 34 where the exhaust plume of the rocket 34 passes through the launch tube 16 and past the launcher connector 42, but could be used in any application where the connector 42 requires protection from external elements.

The blind-mating rocket launcher connector and protection system 10 comprises two mechanisms, the launcher connector mechanism 44 and the protective cover mechanism 46. These mechanisms 44, 46 are housed inside of a launch tube keyway assembly 30 near or at the front of the launch tube or extender tube 16. The launch tube keyway 32 aligns with an aerodynamic hood 36 at the front of the rocket 34 that contains the rocket connector 38. The two mechanisms work in harmony to ensure proper operation of the launcher connector 42. The launcher connector 42 is protected prior to installation of the rocket 34 and during the launch of the rocket 34. The protective cover mechanism 46 automatically retracts out of the way during (i.e. as a result of) the rocket 34 loading process. Once the launcher connector 42 is exposed, the blind mating features and the ability of the launcher connector mechanism 44 to float with multiple degrees of freedom ensures that the connectors 38, 42 properly mate regardless of the rocket 34 position in the launch or extender tube 16 or the connector 42 to connector 38 misalignment. As the rocket 34 exits the tube 16, the launcher connector mechanism 44 and protective cover mechanism 46 quickly return to a home or default position. This ensures protection and proper positioning of the launcher connector 42 whereby said connector 42 is properly positioned for the next rocket 34 insertion.

As may be expected, the outside diameter of the rocket 34 is slightly smaller than the inside diameter of the launch tube 16. The present art launcher connector mechanism 44 allows the rocket 34 to move freely inside the tube 16 yet mate and interface (i.e. maintain connectivity) with the launcher connector 42. If the launcher connector mechanism 44 were to restrict movement of the rocket 34, it would induce undesirable stresses in or on the rocket connector 38. The rocket 34 loading process also requires rocket 34 insertion from the front portion 26 with said rocket 34 pushed backward past a rocket retention clip and then pushed (or pulled) forward until latched in place. Therefore, it is necessary for the launcher connector mechanism 44 to have floating characteristics in both a radial and a longitudinal direction as well as an axial rotation capability. The radial float of the connector mechanism 44 allows the connectors 38, 42 to remain engaged without restricting radial movement of the rocket 34 inside the launch tube 16. The connector mechanism 44 is also able to rotate a limited amount when engaged to allow for any rotational misalignment between the rocket 34 and the launch tube 16. The longitudinal float of the launcher connector mechanism 44 allows for proper connection of the rocket 34 throughout the loading procedure.

In order to ensure the proper mating of the two connectors 38, 42, the launcher connector mechanism 44 must be positioned properly in the launch tube keyway 32 prior to mating. The home position and a proper rotational alignment is ensured by two sets of mating surfaces. The launcher connector 42 is installed into a connector collar 48 of a floating connector member 47 which installs into the launch tube keyway 32. Mating conical surfaces 50, 52 (i.e. a connector mechanism conical surface 50 and a keyway conical surface 52) on the floating connector member 47 of the connector mechanism 44 (rear of the connector collar 48) and the launch tube keyway 32 position the launcher connector mechanism 44 radially inside the launch tube keyway 32. A lengthwise key 54 having a taper (enlarged taper section 74 for the preferred embodiment) on a portion of the floating connector member 47 and a mating or keyway slot 56 at or near a rear portion 58 of the launch tube keyway 32 ensure proper rotational alignment of the launcher connector mechanism 44 prior to installation of the rocket 34 and further restricts axial movement. These simultaneous contact areas 50, 52, 54, 56 combine to ensure proper positioning of the launcher connector 42. Said contact areas 50, 52, 54, 56 are forced into contact via a connector mechanism spring 60 (preferably compression yet leaf, torsional, or other types of spring members may be utilized) between a flange 62 of the floating connector member 47 and a spring retainer 64 of the keyway assembly 30. The spring 60 is pre-compressed and contacts said spring retainer 64 mounted at or near the rear portion 58 of the keyway assembly 30. The spring 60 forces the connector member 47 forward away from the spring retainer 64 and thereby brings each of said conical 50, 52 surfaces into contact. The connector mechanism spring 60 is sized to ensure it provides enough force to overcome the mating force of the connectors 38, 42 but not so much as to hinder installation of the rocket 34.

As the rocket 34 position can vary inside the launch tube 16 during installation, the two connectors 38, 42 must be able to blindly mate and guide each other into alignment to ensure proper mating. This is accomplished by a conical lead-in on the rocket connector and a tapered key 66 on the launcher connector 42. The conical lead-in on the rocket connector 38 contacts the barrel of the launcher connector 42 and aligns the inside diameter of the rocket connector 38 with the outside barrel of the launcher connector 42. At this point, the tapered key 66 of the launcher connector 42 comes into contact with a connector keyway 37 at the top of the rocket connector 38. The tapered key 66 causes the launcher connector 42 to rotate in order to align with the rocket connector 38. The combination of the conical lead in and the tapered key 66 ensure alignment of the two connectors 38, 42. The aforesaid elements allow for proper mating even if there is a misalignment of the rocket 34 in the launch tube 16 or if manufacturing tolerances of the various components are at a limit.

In order for the launcher connector 42 to move from the home position into proper alignment with the rocket connector 38, the floating connector member 47 must begin to float as the rocket 34 is installed. This is accomplished via a reduced diameter section 68 of the floating connector member 47 which floats inside a larger clearance hole 70 near or at the rear portion 58 of the launch tube keyway 32 and a reduced width section 72 of the lengthwise key 54 on the floating connector member 47 which floats within the larger keyway slot 56. As the two connectors 38, 42 contact, and the rocket 34 is forced in the aft direction, it forces the launcher connector mechanism 44 backwards, compressing the connector mechanism spring 60 at the aft end of the floating connector member 47. This separates the two conical mating surfaces 50, 52 of the launch tube keyway 32 and floating connector member 47 while simultaneously separating the lengthwise key 54 of the floating connector member 47 from the keyway slot 56 at the rear of the launch tube keyway 32. The separation of these two contact areas allows the launcher connector mechanism 44 to begin to float. This float allows the launcher connector 42 to orient itself with the rocket connector 38. The launcher connector mechanism 44 motion is restricted enough to prevent gross movement which could begin to interfere with the rocket 34 or prevent return to the proper home position after launch of the rocket 34. This motion is limited in a couple of ways. The lengthwise key 54 of the floating connector member 47 runs substantially the full length of the reduced diameter section 68 so that it remains within the keyway slot 56 near or at the rear portion 58 of the launch tube keyway 32. This restricts or prevents over-rotation of the launcher connector 42 and ensures that the enlarged taper section 74 at the back of the lengthwise key 54 will re-engage the keyway slot 56 and rotate the connector 42 back into the proper orientation.

The launcher connector mechanism 44 or assembly is captive inside the launch tube keyway assembly 30. Said keyway assembly 30 has a connector mechanism slot 76 within which the floating connector member 47 fits and is retained. Within the preferred embodiment, a retainer 78 is placed within said connector mechanism slot 76 after said floating connector member 47 is fitted to further capture said connector member 47. Upon keyway assembly 30 attachment with the launch tube 16, the launcher connector mechanism 44 is captured within the keyway assembly 30. At the aft end 83 of the floating connector member 47, the conical surface 50 stops the forward movement of the launcher connector mechanism 44 once it reaches the home position. This positions the connector 42 to mate with an inserted rocket 34 and also positions the launcher connector 42 to be protected by the protective cover mechanism 46. At the forward end of the floating connector member 47 is an increased diameter section or connector collar 48 which houses the launcher connector 42. This increased diameter section or connector collar 48 is larger than the clearance hole 70 near or at the back of the connector mechanism slot 76, limiting the aft travel of the launcher connector mechanism 44 and keeping it captive. The length of the reduced diameter section 68 of the floating connector member 47 is enough to allow full insertion of the rocket 34 into the launcher 11 and also account for all tolerances in the length of the rocket 34 and launcher 11. This ensures that the launcher connector mechanism 44 will never restrict insertion of the rocket 34.

The floating connector member 47 also acts as a protector or protective device for the launcher connector wires. The floating connector member 47 preferably has a threaded hole 80 for installation of the launcher connector 42 and a through hole 82 continues the entire length of the floating connector member 47. The launcher connector wires pass through the floating connector member 47 and exit the aft end 83 of the floating connector member 47 behind the rear portion 58 of the keyway assembly 30 and spring retainer 64. The wires are thus protected inside the floating connector member 47 from the rocket 34 exhaust plume as it passes through the launch tube 16 and launch tube keyway 32. Alternative embodiments may forego use of the threaded hole 80 or through hole 82 without departing from the scope and spirit of the present art.

Connector 42 alignment is further achieved by placing a connector pin 84 between the connector collar 48 and the launcher connector 42. The launcher connector 42 is threaded into the connector collar 48 until fully seated. (preferably into a threaded hole 80 within said collar 48) It is then backed off until a slot 86 within an outer flange 88 of the launcher connector 42 aligns with a hole 90 in a collar flange 92 at the front of the connector collar 48. The connector pin 84 is pressed through the launcher connector slot 86 and into the hole 90 in the connector collar 48. This prevents the launcher connector 42 from rotating with respect to the connector collar 48 and ensures that they are rotationally aligned. There is some slight variation in the longitudinal position of the launcher connector 42 due to variations in the threads, but it is never more than one thread width and this variation is easily accounted for by the longitudinal travel of the launcher connector mechanism 44.

While the launcher connector mechanism 44 allows the blind mating of the launcher connector 42 and rocket connector 38, it is also necessary for the system to ensure protection of the contacts within the launcher connector 42 after a rocket 34 is ignited and begins to exit the launch tube 16. The rocket 34 exhaust plume is contained by the launch tube 16 and, if not protected, the launcher connector 42 would be exposed to the exhaust plume, resulting in degradation and eventual failure of the launcher connector 42. A protective cover mechanism 46 protects said launcher connector 42 and also retracts out of the way during installation of the rocket 34.

The protective cover mechanism 46 comprises a connector cover 96 and preferably a gasket 98, a cam 100, one or more linkage bars 102, pivot pins 104, and a torsion spring 106 or other type of bias. Alternative embodiments of the protective cover mechanism 46 may not utilize all of the aforesaid components yet provide the function as described. The cam 100, connector cover 96, and linkage bars 102 form a linkage that causes the cam 100 and connector cover 96 to pivot together in opposite directions. The cam 100 pivots forward and downward into the launch tube keyway 32 and is exposed so that it comes into contact with the aerodynamic hood 36 at the front of the rocket 34 during installation of the rocket 34. The connector cover 96 pivots rearward and contacts the launcher connector 42. A gasket 98 on the aft surface 108 of the connector cover 96 compresses against the barrel of the launcher connector 42 forming a protective seal. For the preferred embodiment, said gasket 98 is formed from a high temperature flexible material such as a closed cell extreme-temperature silicone foam with alternative embodiments utilizing other materials or no gasket at all.

The cam 100 comprises a unique cross section or side profile. Although described in cross section or profile, it is understood that the profile described represents surfaces of the cam 100. For cam 100 profile description purposes, a rectangular coordinate system is utilized with the vertex of abscissa and ordinate beginning at the location of a center of the rotating cam pin 109 as seen in the right side plan view of FIG. 34. Beginning in a counterclockwise direction for description purposes, the cam cross section is a substantially first straight line or first wall 121 environmentally placed within the recess 122 and slightly extending into the launch tube keyway 32. When mounted within the keyway assembly 30 with the connector cover 96 impinging upon the connector 42, the first wall 121 is canted slightly clockwise from ordinate parallel and has a negative abscissa value relative to a the rectangular coordinate system located at the center of said pin 109. The first wall 121 thereafter has a first radius transition 124 to a second substantially straight line portion 126 canted slightly clockwise from abscissa parallel and having a negative ordinate value. Preferably, a linkage recess 103 is located within a portion of the surface of said second substantially straight line portion 126 within which the one or more linkage bars 102 pivotally attach with said cam 100. The second substantially straight line portion 126 thereafter has a second radius transition 128 to a third substantially straight line portion 130 canted partially counterclockwise from ordinate parallel and with a positive abscissa value. For the preferred embodiment, the linkage recess 103 is also located within a portion of the surface of said third substantially straight line portion 130. The third straight line portion 130 thereafter transitions to said first wall 121 first straight line portion around the rotating cam pin 109 via a third radius transition 132 at a positive ordinate value. The aforesaid is a cross sectional description of the cam 100 within the apparatus 10 environment and is provided for enablement purposes. Although described for enablement purposes, the cam 100 profile may take a plurality of forms or profiles as understood by those skilled in the art without departing from the scope and spirit of the present art apparatus 10, provided the beneficial aspects of the present art apparatus 10 are satisfied.

For the preferred embodiment, said cam 100 is biased or forced forward (i.e. toward said front portion 26) through the use of a torsion spring 106 and a rotating cam pin 109. (As further described herein, the bias upon the cam 100 also provides a bias upon the connector cover 96 whereby said cover 96 is at a home position seated or touching with the connector 42.) The cam 100 is fixed in orientation relative to said cam pin 109 through the use of a set screw 110. This ensures that said cam 100 rotates with said pin 109. Said torsion spring 106 is preferably mounted onto said cam pin 109 externally to said launch tube keyway housing 40 with alternative embodiments mounting said spring 106 internal to said housing 40 or further utilizing a coil, leaf, or other type of spring or bias internally or externally. For the preferred embodiment, a first leg 112 on one end of the spring 106 is bent inward and mates through a pin slot 114 in the cam pin 109, while the second leg 116 is rotated around a boss 118 externally mounted with the keyway assembly 30 or keyway housing 40. The energy stored within the spring 106 is utilized to rotate the cam 100 forward upon launch. For the preferred embodiment, two linkage bars 102 are connected from the bottom rear of said cam 100 (i.e. within said linkage recess 103 near said second radius transition 128) to a top portion 97 of the connector cover 96. The connector cover 96 rotates about a fixed pivot pin 104 and pivots into the launch tube keyway 32 when a rearmost portion of said aerodynamic hood 36 impinges upon said cam 100 during rocket 34 installation with said extender tube 16. That is, the top portion 97 of said connector cover 96 represents a moment arm substantially opposite the connector cover 96 between which is the fixed pivot pin 104. As seen in FIGS. 6-17 & 34, when the top portion 97 is moved toward the rear portion 58 of the keyway assembly 30 via said linkage bar 102, the connector cover 96 moves toward the front portion 26 of said keyway assembly 30. Alternative embodiments may utilize a single linkage bar 102 or a plurality of linkage bars 102.

In operation, as a rocket 34 is loaded, the aerodynamic hood 36 presses against the cam 100. The insertion force of the rocket 34 rotates the cam 100 in the aft direction, i.e. toward the rear portion 58 of the keyway assembly 30, compressing the torsion spring 106, and rotating the cam 100 into a recess 122 of the launch tube keyway 32 and out of the way of the aerodynamic hood 36 of the rocket 34 as said hood 36 transitions said keyway 32 from said front portion 26 toward said rear portion 58. The one or more linkage bars 102, between the cam 100 and connector cover 96, transfer this force onto the connector cover 96 top portion 97, simultaneously rotating the connector cover 96 forward (i.e. toward said front portion 26) and into the launch tube keyway 32 recess 122, exposing the launcher connector 42 for mating with the rocket connector 38. As the rocket 34 is inserted, the connector cover 96 rides near or at the external surface of the aerodynamic hood 36.

Upon rocket 34 ignition and during the nascent stages of rocket 34 forward movement, the launcher connector mechanism 44 moves slightly forward (i.e. toward said front portion 26) with the rocket 34. When the conical surfaces 50, 52 of the floating connector member 47 and launch tube keyway 32 begin to contact, the contact forces allow the launcher connector 42 and rocket connector 38 to separate. The launcher connector mechanism 44 is forced forward (i.e. toward said front portion 26) into the home position by the connector mechanism spring 60. As the rocket 34 is moving forward in the launch tube 16 and launch tube keyway 32, the connector cover 96 rides near or at the aerodynamic hood 36. This contact ensures that the cam 100 remains rotated out of the way of the exiting rocket 34. As the rocket 34 moves forward past the connector cover 96, the cam 100 begins to ride on the aerodynamic hood 36, i.e. being forced into the launch tube keyway 32 by the energy stored in the torsion spring 106. As the aerodynamic hood 36 moves forward past the cam 100, the torsion spring 106 forces the cam 100 into its home or rest position behind the first wall 121 within the recess 122 of the launch tube keyway 32 and also behind the aerodynamic hood 36 as it exits the launch tube keyway 32. The connector cover 96, connected to the cam 100 by the linkage bars 102, simultaneously rotates into place in front of the launcher connector 42. The gasket 98 on the aft surface 108 of the connector cover 96 is forced against the launcher connector 42 and forms a seal over the barrel of the launcher connector 42, thereby protecting the contacts, i.e. pins or sockets, from exposure to the passing rocket 34 exhaust plume.

While the force of the rocket 34 insertion is utilized to retract the cam 100 and connector cover 96, the mechanism ensures that the force of the rocket 34 exhaust plume cannot do so, even though the force of the supersonic exhaust is many times stronger than the installation force of the rocket 34. This is accomplished by controlling the exposed surface area of the components of the keyway assembly 30. That is, the fore surface area 107 of the connector cover 96 opposite said gasket 98 is considerably greater than any portion of the cam 100 whereby pressures from the exhaust plume maintain the connector cover 96 in a position which protects the launcher connector 42. Said protection is furthered by the fact that a portion of the first wall 121 surface of the cam 100 is protected from the rocket 34 plume behind the cam wall 120 within a recess 122 within the launch tube keyway 32. This allows a space for the cam 100 and connector cover 96 to retract and also prevents the exhaust gases from impinging upon most of the activating surface of the cam 100.

As discussed, the connector cover 96 is designed to allow much more of its surface to be exposed to the exhaust plume. By exposing more surface area of the connector cover 96 than of the cam 100, it ensures that the exhaust plume will tend to force the connector cover 96 rearward and prevent the protective cover mechanism 46 from retracting and exposing the launcher connector 42 to the exhaust gases. The size and position of the connector cover 96 ensures that the launcher connector 42 is protected behind the connector cover 96, thereby preventing the exhaust plume from impinging directly on the launcher connector 42 face and possibly forcing the launcher connector mechanism 44 to retract away from the protective cover 96. That is, for the preferred embodiment, the connector cover 96 is substantially the same or slightly wider than the widest portion of the connector mechanism 44.

The art of the present invention may be manufactured from a plurality of materials including but not limited to metals and alloys thereof, plastics, composites, or ceramics without departing from the scope and spirit herein intended. The apparatus may further be manufactured via molding, machining, casting, forging, pressing, laminating, carving, or utilization of stereo-lithographic or electro-dynamic milling or other techniques which are appropriate for the material utilized. For the preferred embodiment, the apparatus is manufactured from a combination of aluminum and steel alloys.

Although described for enablement purposes, the lengths, widths, and other dimensional attributes may depart significantly from those specified. The shape, size, location, component numbers and mounting methods utilized for the components described may take a plurality of forms as recognized within pertinent arts without departing from the scope and spirit of the present invention.

Having described the invention in detail, those skilled in the art will appreciate that modifications may be made to the invention and its method of use without departing from the spirit herein identified. Therefore, it is not intended that the scope of the invention be limited to the specific embodiments illustrated and described. Rather, it is intended that the scope of this invention be determined by the appended claims and equivalents thereof.

What is claimed is:

1. A blind-mating rocket launcher connector and protection system, comprising:

a keyway assembly having a front portion, a rear portion, a launcher connector mechanism and a protective cover mechanism; and said launcher connector mechanism having a floating connector member with a connector capable of a self centering connection; and said launcher connector mechanism capable of a positive blind mating with a rocket connector of a hood of a rocket; and said protective cover mechanism having a pivoting connector cover, a pivoting cam, and one or more linkage bars between said cam and said connector cover whereby a first pivot of said cam toward said rear portion creates a second pivot of said connector cover toward said front portion; and said pivoting connector cover having a bias at a home position upon said connector of said floating connector member and covering at least a portion of said connector when in said home position; and said cam positioned to impinge upon the hood of the rocket during an installation of the rocket and said connector cover positioned to move from said home position and uncover said connector of said floating connector member when the hood impinges upon said cam; and said connector cover positioned to move to said home position under said bias upon a launch of the rocket when the hood is not impinging upon said cam prior to an exhaust plume of the rocket reaching said floating connector.

2. The blind-mating rocket launcher connector and protection system as set forth in claim 1, further comprising:

said connector cover having a fore connector surface area sufficient to maintain said connector cover in said home position when exposed to an exhaust plume of the rocket.

3. The blind-mating rocket launcher connector and protection system as set forth in claim 2, whereby:

said cam having a portion of a first wall surface protected from the exhaust plume by a cam wall.

4. The blind-mating rocket launcher connector and protection system as set forth in claim 3, said keyway assembly further comprising:

a launch tube keyway having a recess forming at least a portion of said cam wall; and said launch tube keyway of sufficient size to fit the hood of the rocket.

5. The blind-mating rocket launcher connector and protection system as set forth in claim 4, further comprising:

said floating connector member having a connector collar within which said connector is retained; and said floating connector member having a reduced diameter section having a lengthwise key capable of ensuring a rotational alignment of said launcher connector mechanism; and said floating connector member having a connector mechanism conical surface capable of mating with a keyway conical surface whereby said launcher connector mechanism positions radially; and said lengthwise key having a reduced width section capable of floating within a keyway slot; and said lengthwise key having an enlarged taper section near or at a back of said lengthwise key capable of engaging said keyway slot whereby said connector is placed into a proper orientation or alignment.

6. The blind-mating rocket launcher connector and protection system as set forth in claim 5, further comprising:

a connector mechanism spring at or near said rear portion of said keyway assembly capable of forcing said connector mechanism conical surface and said keyway conical surface into contact; and a through hole within said floating connector member through which one or more wires may pass, are substantially protected, and exit an aft end; and said connector having a tapered key capable of aligning with a connector keyway of said rocket connector and aligning said connector and said rocket connector.

7. The blind-mating rocket launcher connector and protection system as set forth in claim 1, said floating connector member further comprising:

a connector collar within which said connector is retained; and a reduced diameter section having a lengthwise key capable of ensuring a rotational alignment of said launcher connector mechanism; and a connector mechanism conical surface capable of mating with a keyway conical surface whereby said launcher connector mechanism positions radially.

8. The blind-mating rocket launcher connector and protection system as set forth in claim 7, further comprising:

a keyway slot within said keyway assembly of a size to mate with said lengthwise key and further ensure said rotational alignment of said launcher connector mechanism.

9. The blind-mating rocket launcher connector and protection system as set forth in claim 8, further comprising:

a connector mechanism spring at or near said rear portion of said keyway assembly capable of forcing said connector mechanism conical surface and said keyway conical surface into contact; and a through hole within said floating connector member through which one or more wires may pass, are substantially protected, and exit an aft end.

10. The blind-mating rocket launcher connector and protection system as set forth in claim 7, said lengthwise key further comprising:

a reduced width section capable of floating within a keyway slot; and an enlarged taper section near or at a back of said lengthwise key capable of engaging said keyway slot whereby said connector is placed into a proper orientation or alignment.

11. The blind-mating rocket launcher connector and protection system as set forth in claim 1, further comprising:

a connector mechanism spring at or near said rear portion of said keyway assembly; and a through hole within said floating connector member through which one or more wires may pass, are substantially protected, and exit an aft end.

12. The blind-mating rocket launcher connector and protection system as set forth in claim 1, further comprising:

said connector having a tapered key capable of aligning with a connector keyway of said rocket connector and aligning said connector and said rocket connector.

13. A blind-mating connector and protection system, comprising:

a connector mechanism and a protective cover mechanism; and said connector mechanism having a floating connector member; and said floating connector member having a connector collar with a connector; and said protective cover mechanism having a connector cover with a top portion, a fore surface, and an aft surface capable of being forced against said connector and covering one or more pins or sockets of said connector; and said protective cover mechanism having a cam and one or more linkage bars between said cam and said top portion; and a rearward pivot of said cam creating a forward pivot of said connector cover whereby said connector is uncovered.

14. The blind-mating connector and protection system as set forth in claim 13, further comprising:

said floating connector member having a lengthwise key capable of mating with a keyway slot whereby a proper rotational alignment of said connector mechanism is provided.

15. The blind-mating connector and protection system as set forth in claim 14, further comprising:

said floating connector member having a first conical surface capable of mating with a second conical surface whereby when said first and said second conical surfaces contact said connector mechanism is positioned radially.

16. The blind-mating connector and protection system as set forth in claim 15, further comprising:

said connector member having a reduced diameter section capable of floating within a larger clearance hole; and said lengthwise key having a reduced width section capable of floating within a larger keyway slot whereby said floating connector member may float.

17. The blind-mating connector and protection system as set forth in claim 15, further comprising:

a connector mechanism spring retained by a spring retainer; and said connector mechanism spring positioned to force said first conical surface into contact with said second conical surface.

18. The blind-mating connector and protection system as set forth in claim 13, further comprising:

said floating connector member having a first conical surface capable of mating with a second conical surface whereby when said first and said second conical surfaces contact said connector mechanism is positioned radially.

19. The blind-mating connector and protection system as set forth in claim 13, whereby:

said protective cover mechanism is biased whereby said cam is forced in a forward direction and said connector cover is forced in a rearward direction against said connector.

20. The blind-mating connector and protection system as set forth in claim 19, further comprising:

a tapered key on said connector capable of aligning with a connector keyway of a second connector and align said connector and said second connector.

* * * * *